US007713385B2

(12) United States Patent
Rheims et al.

(10) Patent No.: US 7,713,385 B2
(45) Date of Patent: May 11, 2010

(54) APPARATUS FOR TREATING A MATERIAL WEB AFTER A NIP

(75) Inventors: Jörg Rheims, Tönisvorst (DE); Günter Bonk, Mönchengladbach (DE); Jochen Autrata, Neukirchen-Vluyn (DE)

(73) Assignee: Voith Paper Patent GmbH, Heidenheim (DE)

( * ) Notice: Subject to any disclaimer, the term of this patent is extended or adjusted under 35 U.S.C. 154(b) by 855 days.

(21) Appl. No.: 11/304,606

(22) Filed: Dec. 16, 2005

(65) Prior Publication Data

US 2006/0137846 A1 Jun. 29, 2006

(30) Foreign Application Priority Data

Dec. 24, 2004 (DE) ..... 10 2004 062 563

(51) Int. Cl.
*D21F 3/00* (2006.01)
*D21F 3/02* (2006.01)
*D21G 1/00* (2006.01)

(52) U.S. Cl. ..... 162/359.1; 162/375; 34/122; 34/629; 34/634

(58) Field of Classification Search ..... 162/375, 162/206, 207, 359.1; 34/122, 629, 634
See application file for complete search history.

(56) References Cited

U.S. PATENT DOCUMENTS 4,506,456 A * 3/1985 Lehtinen ..... 34/380
5,009,016 A * 4/1991 LePisto et al. ..... 34/421
5,245,920 A 9/1993 Hess
5,404,654 A * 4/1995 Babinsky et al. ..... 34/122
6,207,019 B1 * 3/2001 Zwart et al. ..... 162/207
6,694,640 B1 * 2/2004 Kayser ..... 34/402

FOREIGN PATENT DOCUMENTS

DE 101 57 690 2/2003
EP 1 357 225 10/2003
WO WO 01 75224 A1 * 4/2001

OTHER PUBLICATIONS

Smook, Handbook for Pulp and Paper Technologists, 1992, Angus Wilde Publications, 2nd edition, p. 255-257 and 273.*
Smook, Handbook for Pulp and Paper Technologists, 1992, Angus Wilde Publications, 2nd edition, p. 271.*
FLS, Inc translation services, Certified English Translation of DE 10157690, orginal document publication Feb. 20, 2003 [translated Aug. 2008], whole document.*

* cited by examiner

*Primary Examiner*—Eric Hug
*Assistant Examiner*—Anthony J Calandra
(74) *Attorney, Agent, or Firm*—Hershkovitz & Associates, LLC; Abraham Hershkovitz

(57) ABSTRACT

Apparatus and method for treating a material web, which has at least one nip through which the material web is guided and which is formed between a first revolving, heated surface and a second revolving surface, it being possible for the first surface to be heated to at least 120° C. and both surfaces in the nip having the same direction of movement as the material web. Good surface quality of the material web is obtained by providing a box which bounds a space through which the material web is guided, the space being arranged after the first or after the last nip in the direction of movement of the web.

21 Claims, 2 Drawing Sheets

APPARATUS FOR TREATING A MATERIAL WEB AFTER A NIP

CROSS-REFERENCE TO RELATED APPLICATIONS

The present application claims priority under 35 U.S.C. §119 of German Patent Application No. 10 2004 062 563.8, filed on Dec. 24, 2004, the disclosure of which is expressly incorporated by reference herein in its entirety.

BACKGROUND OF THE INVENTION

1. Field of the Invention

The invention relates to an apparatus for treating a material web, which has at least one nip through which the material web is guided and which is formed between a first revolving, heated surface and a second revolving surface, it being possible for the first surface to be heated to at least 120° C. and both surfaces in the nip having the same direction of movement as the material web. Furthermore, the invention relates to a method for treating a material web, in which the material web is guided through a nip which is formed between a first revolving, heated surface and a second revolving surface, the first surface being heated to at least 120° C.

In the following text, the invention will be described by using the example of a paper web. However, it can also be used with other material webs in which similar problems occur.

2. Discussion of Background Information

In order to improve surface quality and for the purpose of consolidation, paper webs are guided through at least one nip which, as a rule, is formed in what is known as a calender. In this case, the nip can be formed by two rolls, of which one is heated. The other roll then often has a resilient surface. However, the nip can also be formed by a heated roll and a shoe roll interacting therewith. The shoe roll has a cover which is brought into contact with the opposing roll over a predetermined circumferential section by a pressure element. Other configurations of the nip are of course likewise conceivable, for example a configuration in which the nip is formed by two circulating belts.

It is known that the surface quality can be improved if heat is supplied to the paper web in the nip. For this purpose, one of the two surfaces is heated, for example the surface of a heated roll. Although, in principle, this has positive effects on the surface of the paper web, it can lead to the problems discussed below.

At the end of the nip, the operating pressure is reduced, more or less abruptly, to the ambient pressure. Then, if the paper still has a temperature above the boiling point of the water contained at approximately ambient pressure, that is to say about 1 bar, the water evaporates abruptly. This is already intrinsically a problem, since the moisture of the paper or board web can thus fall below a desired level. This can, for example, impair downstream processes, such as a printing process. On the other hand, on account of technical restrictions in upstream processes, it is often not possible to increase the web moisture upstream of the nip in order to remedy this problem.

Furthermore, the water evaporating abruptly can lead to fibres being swept along and caused to stand up, and thus to a worsening of the surface quality. This applies even if the fibres are not torn completely out of the paper web.

SUMMARY OF THE INVENTION

The present invention improves the surface quality of the material web.

In an apparatus of the type described on page 1 of the instant specification, the improved surface quality is realized by having a box which bounds a space through which the material web is guided, arranged after the nip in the direction of movement of the web.

The space expediently extends over the entire width of the paper web. Approximately ambient pressure prevails in the space. This would initially lead to steam emerging from the paper web in this case as well and damaging the surface. However, since the steam cannot escape from the space to a greater extent on account of the box, an atmosphere which contains saturated water vapor builds up in a relatively short time interval.

Since there is water vapor both inside the paper web and outside the paper web, the transfer of water vapor from the paper web into the surroundings is highly restricted. In an ideal case, the transfer is completely prevented. The paper web can then cool down as it passes through the space without losing moisture. When the web leaves the space, further cooling takes place, without a considerable loss of moisture. In any case, the moisture loss is lower than without the box.

The box is preferably closed apart from an inlet opening, which is closed by the two surfaces, and an outlet opening, through which the material web is guided to the outside. The emergence of steam from the space is therefore restricted to a considerable extent. This has a number of advantages. Firstly, the surroundings are subjected to steam only to a small extent. This avoids condensation problems on colder parts of machines. Furthermore, the material web is covered on both sides by a steam atmosphere, so that flash evaporation, that is to say the abrupt emergence of steam, cannot occur on either of its two sides.

The second surface is preferably formed by a circulating cover, which is supported from the inside in the region of the box. The second surface is therefore formed on the surface of the cover of a shoe roll. Such a cover is compliant from a certain point of view. If the cover is supported in the region of the box, then it is possible to achieve a predetermined level of tightness between the box and the cover. This tightness can firstly be achieved by a sealing strip which bears on the cover during operation. Secondly, it can be achieved to a lesser extent if there is a small gap between the cover and the box. However, the support ensures that this gap has a predetermined magnitude.

In an alternative configuration, provision can be made for the space to be bounded on one side by the material web, the box being arranged adjacent to the heated surface. The box will expediently be constructed in such a way that it covers the paper or board web on both sides, in order to minimize the evaporation from the web as far as possible. However, if this is not possible, for example for constructional reasons, then the box should cover the hotter web side, that is to say the side which has rested on the heated surface in the nip.

The box preferably has a length which, while taking account of the temperature of the first surface and of the speed of the material web, is chosen such that the material web has a temperature of at most 110° C. after passing through the space. The speed of the material web and the temperature of the first surface are known. Therefore, with knowledge of these two parameters, the length of the space can easily be calculated or determined with sufficient accuracy by way of experiments or heat transfer calculations. If the material web at the end of the space is still only 10° C. or even only 5° C.

above the boiling point of water at ambient pressure, then the risk of flash evaporation with tearing of the surface is reduced quite substantially.

The space preferably has a length in the range from approximately 0.3 m to 3 m in the direction of movement. Such a length is normally sufficient to effectuate the necessary cooling of the web after leaving the nip.

At least one wall of the box is preferably heated to at least 100° C. The temperature of 100° C. in this case represents the boiling point of the water. If the pressure conditions change, this temperature must be raised or lowered. If the box is heated, then the risk that steam will condense on the wall of the box is minimized. This would lead to the formation of drops, which is undesirable.

In this case, it is preferred for the heated wall to be arranged above the web in the direction of the force of gravity. Here, the risk of drop formation is particularly critical.

The box is preferably at least partly thermally insulated with respect to the surroundings. In this way, the dissipation of heat from the space to the outside is reduced. This in turn saves energy and prevents drop formation on the outside.

In a preferred refinement, a blowing device is provided which conveys fresh air into the space. With the aid of the blowing device, it is possible to ensure that no condensation takes place in the space. Therefore, part of the steam-saturated air in the box is always replaced by unsaturated ambient air. Account is therefore taken of the fact that the web is quite capable of transporting more moisture into the box than can escape from the box through the remaining openings and leaks.

The blowing device is preferably connected to a sensor which determines the relative humidity in the space. It is therefore possible to monitor whether there is the risk of condensation. The blowing device can be controlled accordingly.

In this case, it is preferred for the blowing device and the sensor to be part of a control system which limits the relative humidity in the space to at most 99%. At this relative humidity there is no risk that drops will be formed by condensate.

A plurality of nips are preferably provided and the space is arranged after the first nip. The plurality of nips can be provided, for example, in a supercalender or in a Janus calender. The loss of moisture is normally greatest in the first nip. Here, the space therefore also has the greatest effects.

Alternatively or additionally, provision can be made for a plurality of nips to be provided and for the space to be arranged after the last nip. In this way, after the last nip, there is once more the possibility of setting the moisture of the web correctly. Furthermore, it is optimal to have the desired smooth surface after the last nip. This is ensured in a straightforward manner by the steam atmosphere in the space.

With regard to the novel method according to an embodiment of the invention, the material web, after leaving the nip, is guided through a space which is partly bounded by the heated surface and in which a steam atmosphere is produced with the aid of the material web.

The space is enclosed. The moisture brought into the space by the web as a result of evaporation is therefore maintained in the form of a steam atmosphere. If there is sufficient saturated steam present in the space, then the steam can no longer be transferred from the paper web into the space. As it passes through the space, the paper web can therefore cool down to a sufficient extent such that, after leaving the space, there is no longer any risk that the surface will be torn again as a result of abrupt emergence of the steam.

Fresh air is preferably blown into the space. As a result of blowing the fresh air in, some of the steam can be conveyed out of the space. It is therefore possible to keep the steam atmosphere at a predetermined relative humidity or moisture, so that the risk of condensation is reduced.

In this case, the relative humidity in the space is determined and the relative humidity is limited to at most 99% by blowing in fresh air. Therefore, the risk of droplet formation by condensate is ruled out.

At least one boundary wall of the space is preferably heated. This ensures that the steam atmosphere in the space is maintained and no steam can be deposited on the wall in the form of water.

According to one aspect of the invention, an apparatus for treating a material web comprises at least one nip through which the material web is guided and which is formed between a first revolving, heated surface and a second revolving surface. The first surface is heatable to at least 120° C. and both surfaces in the nip have the same direction of movement as the material web, a box which bounds a space through which the material web is guided being arranged after the nip in the direction of movement of the material web.

According to other aspects of the invention, the box may be closed, except for an inlet opening, which is closed by the two surfaces, and an outlet opening, through which the material web is guided to the outside. The second surface may be formed by a circulating cover, which is supported from the inside in the region of the box. The space may be bounded on one side by the material web, the box being arranged adjacent to the first heated surface. The box may have a length which, while taking account of the temperature of the first surface and of the speed of the material web, is chosen such that the material web has a temperature of at most 110° C. after passing through the space. The space may have a length in the range from approximately 0.3 to 3 m in the direction of movement of the web. At least one wall of the box may be heated to at least 100° C. The heated wall is arranged above the web in a direction of the force of gravity. The box may be at least partly thermally insulated with respect to its surroundings.

According to further aspects of the invention, a blowing device may convey fresh air into the space. A sensor may be connected to the blowing device for determining the relative humidity in the space. The blowing device and the sensor may be part of a control system which limits the relative humidity in the space to at most 99%. The at least one nip may comprise a plurality of nips and the space may be arranged after a first nip in the direction of movement of the web. Alternatively, or additionally, the at least one nip may comprise a plurality of nips and the space may be arranged after a last nip in the direction of movement of the web. The at least one nip may comprise an extended nip. The at least one nip may be formed between a hard roll and a soft roll having a resilient surface. Alternatively, the at least one nip may be formed between two hard rolls. Further yet, the at least one nip may have a flat extent and be formed between two circulating belts, the apparatus further comprising pressure shoes for pressing the circulating belts against each other.

According to still further aspects of the invention, the first revolving, heated surface may comprise a roll and the second revolving surface may comprise a cover of a shoe roll. A first seal may be provided for sealing off the box with respect to the roll and a second seal may be provided for sealing off the box with respect to the cover of a shoe roll. A support may be provided for supporting, in the region of the second seal, the cover of a shoe roll, so that the cover of a shoe roll in the region of the second seal has a defined position in relation to the second seal. The first seal and the second seal may bear on one of, the roll or the cover of a shoe roll. Alternatively, a small gap may be left between the box and one of, the roll or the cover of a shoe roll. The box may be sufficiently large to enable the space to extend over an entire width of the web. The box may be closed at its sides. Alternatively, the box may be open at its sides. The box may be heated with the aid of the roll and may insulate part of a circumference of the roll with respect to its surroundings.

According to another aspect of the invention, an apparatus for treating a material web comprises at least one nip through which the material web is guided and which is formed between a roll and a cover of a shoe roll, the roll being heatable to at least 120° C. The roll and the cover of a shoe roll have the same direction of movement as the material web. A box bounds a space through which the material web is guided and is arranged after the nip in the direction of movement of the material web, at least one wall of the box being heated to at least 100° C. The at least one wall is arranged above the web in a direction of the force of gravity. The box is at least partly thermally insulated with respect to its surroundings. Fresh air is conveyed into the spave by a blowing device. A sensor is connected to the blowing device for determining the relative humidity in the space. A first seal seals off the box with respect to the roll, the first seal bearing on one of, the roll or the cover of a shoe roll. A second seal seals off the box with respect to the cover of a shoe roll, the second seal bearing on one of, the roll or the cover of a shoe roll. A support is provided for supporting, in the region of the second seal, the cover of a shoe roll, so that the cover of a shoe roll in the region of the second seal has a defined position in relation to the second seal.

The method for treating a material web according to one aspect of the invention, comprises guiding the material web through a nip formed between a first revolving, heated surface and a second revolving surface, heating the first surface to at least 120° C., and guiding the material web, after leaving the nip, through a space which is partly bounded by the heated surface and in which a steam atmosphere is produced with the aid of the material web.

According to other aspects of the invention, fresh air may be blown into the space, the relative humidity is determined in the space and the relative humidity is limited to at most 99% by blowing in fresh air. At least one boundary wall of the space may be heated.

The method for treating a material web according to a further aspect of the invention, comprises guiding the material web through a nip formed between a first revolving, heated surface and a second revolving surface, heating the first surface to at least 120° C., the guiding of the material web, after leaving the nip, being through a space which is partly bounded by the heated surface and in which a steam atmosphere is produced with the aid of the material web, blowing fresh air into the space, determining the relative humidity in the space, limiting the relative humidity to at most 99% by blowing in fresh air, heating at least one boundary wall of the space, sealing off the box with respect to the first revolving, heated surface, by way of a first seal, and with respect to the second revolving surface, by way of a second seal, and supporting the second revolving surface, so that, the second revolving surface in the region of the second seal has a defined position in relation to the second seal.

Other exemplary embodiments and advantages of the present invention may be ascertained by reviewing the present disclosure and the accompanying drawing.

BRIEF DESCRIPTION OF THE DRAWING

The present invention is further described in the detailed description which follows, in reference to the drawing by way of a non-limiting example of an embodiment of the present invention, and wherein.

DETAILED DESCRIPTION OF THE PRESENT INVENTION

Figure 1:
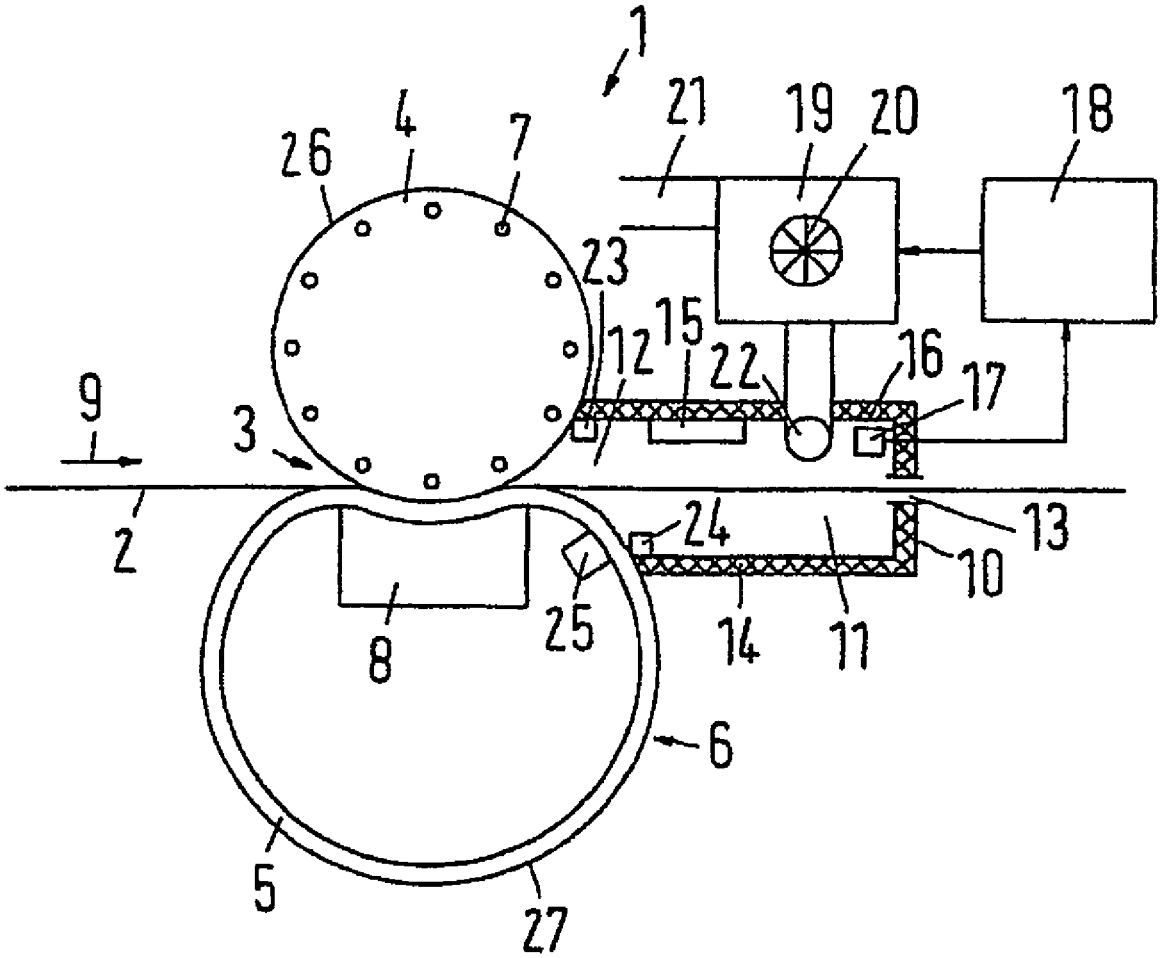
FIG. 1 shows a schematic view of an apparatus for treating a material web.
Figure 2:
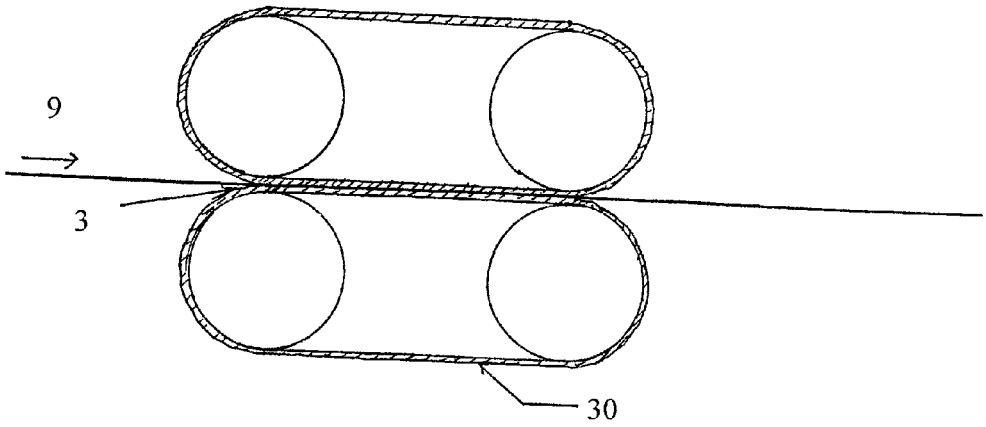
FIG. 2 shows a schematic view of the apparatus with an extended nip.
Figure 3:
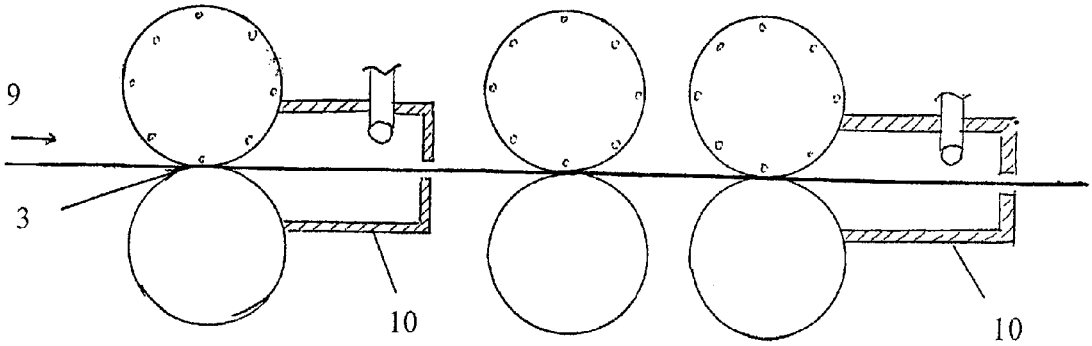
FIG. 3 shows a schematic view of the apparatus with circulating belts and a plurality of nips.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

An apparatus 1 for treating a material web 2, in the present case a web of paper or board, has a nip 3 which is formed between a roll 4 heated to at least 120° C. and a cover 5 of a shoe roll 6. Illustrated in the roll 4 are heating channels 7, which are one possible way of heating. Of course, the roll 4 can also be heated in another way, for example by way of an infrared heater or an inductive heater.

The cover 5 of the shoe roll 6 is brought into contact with a circumferential section of the heated roll 4 by a pressure shoe 8, the web 2 between the roll 4 and the cover 5 of course preventing the cover 5 from resting directly on the roll 4. The nip 3 accordingly has a length in the direction of movement 9 of the web 2 in the range from approximately 30 mm to 250 mm.

In the exemplary embodiment illustrated, the nip 3 is formed as an extended nip. However, it is also possible to form the nip 3 between a hard roll and what is known as a soft roll having a resilient surface, or even to use two hard rolls. It is also possible to form the nip 3 between two circulating belts, which are pressed against each other by pressure shoes in each case. In this case, it is possible for the nip 3 to also have a flat extent.

Arranged after the nip 3 in the direction of movement 9 is a box 10 which, together with the roll 4 and the cover 5, surrounds a space 11. The box 10 has an inlet opening 12, which is closed by the roll 4 and the cover 5, and an outlet opening 13, through which the web 2 leaves the space 11.

The box 10 has thermal insulation 14, which reduces the transfer of heat from the space 11 into the surroundings. Furthermore, the box 10 has a heating device 15, which heats at least the wall 16 arranged above the web 2 in the direction of the force of gravity. Here, the heating device 15 is illustrated as a discrete element. As a rule, however, the heating device 15 will be integrated into the wall 16 or, in a further preferred refinement, into all the walls of the box 10.

A humidity sensor 17 determines the relative humidity in the space 11 and passes this on to a controller 18. The controller 18 is connected to a blowing device 19 which has a blower 20. With the aid of the blower 20, fresh air can be taken in via an intake connector 21 and blown into the space 11 via an entry 22, preferably at the side.

An additional steam connection, with which steam can be blown into the space 11, is certainly possible but generally not necessary, as will be explained below.

The box 10 is sealed off with respect to the roll 4 by a first seal 23 and with respect to the cover 5 of the shoe roll 6 by a second seal 24. In the region of the second seal, the cover 5 is supported by a support 25, so that the cover 5 in the region of the second seal 24 has a defined position in relation to the second seal 24.

The seals 23, 24 can bear on the roll 4 or the cover 5. However, it is also possible to leave a small gap between the box 10 and the roll 4 or the cover 5. The box 10 is so large that the space 11 extends over the entire width of the web 2. The box 10 is also closed at the sides. The single larger opening through which steam could emerge is the outlet opening 13. Alternatively, the box 10 can also be left open at the sides if not too much steam is lost through these lateral openings. However, a closed configuration is preferred.

The length of the box 10 in the direction of movement 9, and therefore the length of the space 11 in the direction of movement 9, is chosen such that, in the case of all of the grades treated in the apparatus I and under all the operating conditions provided, the web 2 has a temperature below 110° C. or even below 105° C. when it emerges from the box. This applies to an ambient pressure of about 1 bar. Expressed in other words, the temperature of the web 2 when it emerges from the box 10 should be no more than 10° C. or even no more than 5° C. above the boiling temperature of water at ambient pressure. As a result, the web 2 cools down without losing moisture significantly. When it leaves the box 10, the further cooling likewise takes place without any considerable loss of moisture, in any case considerably less than without the box 10.

Since the necessary length of the box 10 depends on the grade of the web 2 produced, the type of apparatus 1 and the operating conditions, and also on the speed of the web 2, the length of the box 10 varies from location of use to location of use. However, the length can be determined with sufficient accuracy by way of experiments or heat transfer calculations. The space 11 will normally have a length in the range from approximately 0.3 to 3 m in the direction of movement 9.

In principle, the box 10 can be used in all calenders in which the surface 26 of the heated roll 4 has a temperature of more than 120° C. The temperature of the surface 27 of the cover 5 is of secondary importance here. However, the box 10 is primarily advantageous in the case of calenders in which the web is calendered with temperatures of the surface 26 of more than 200° C. Above all, the box 10 can be used advantageously in the extended nip calender illustrated, since here, in addition to the high temperatures, there is also a relatively high residence time in the nip 3, so that, after the nip 3, temperatures of, for example, 150° C. can occur on the surface of the web 2.

Additional feeding of steam, in order primarily to obtain a steam-controlled atmosphere or to maintain such an atmosphere, is generally not required, as the following estimate indicates:

In the saturated state, 1 $m^3$ of air at 100° C. and 1.013 bar contains about 0.6 kg of water. If the web 2 loses only 0.5 g of water per $m^2$ of its surface (during operation, it is entirely possible for this value to rise to a multiple) in the space 11 at the start of operation, in which there is not yet a steam atmosphere in the space 11, and if the apparatus 1 is operated at 500 m/min (many apparatuses are already running at 2000 m/min today), then in this case assumed to be very unfavourable, 1250 g of water evaporate per minute in the nip of a 5 m wide machine.

If the space 11 has a volume of 0.25 $m^3$ (0.5 m length×0.1 m height×5 m width), then in this volume, even with an ambient humidity initially of 0%, there is already a steam-saturated atmosphere after about 30 seconds. Even if half of the steam should escape while the equilibrium state relating to the steam-saturated atmosphere is established, then despite this unfavorable assumption, the saturated state is achieved after about one minute. Since this state of a box empty of steam is established only when the apparatus 1 is started up from a standstill, and since the production of the web after one minute generally does not yet supply the desired quality in a steady state in any case, this starting phase for filling the box with steam has no effect on the machine efficiency.

Since the walls of the box 10 are heated to slightly above 100° C. and are insulated with respect to the surroundings, the formation of drops which could impair the quality of the web produced is avoided.

Since the heated roll 4 forms at least part of the front boundary of the box 10, the box 10 is heated with the aid of the heated roll 4. The box 10 insulates part of the circumference of the heated roll 4 with respect to the surroundings.

The blowing device 19 replaces enough of the steam-saturated air in the box 10 by unsaturated ambient air, such that no condensation can take place in the space 11. The relative humidity in the space 11 is expediently limited to about 99%.

If possible, the box 10 is constructed in such a way that it covers the web 2 on both sides, in order to minimize the evaporation from the web 2 as far as possible. If this is not possible, for example for constructional reasons, then the box 10 should cover at least the hotter side of the web 2, that is to say the side of the web 2 which rests on the heated roll 4. In this case, the box 10 is adjacent only to the heated roll 4.

By way of the box 10, the moisture can therefore be kept in the web 2. Tearing of the surface as a result of abrupt evaporation is reliably avoided.

In a manner not specifically illustrated, the invention can be used not only in a calender or a roll-based machine having a nip, as has been explained in conjunction with the drawing. The box can also be used in the case of a calender having a plurality of nips, in order to produce the desired steam atmosphere after one or more nips. In this case, for cost reasons, the box will not necessarily be arranged after each nip. In many cases, a beneficial arrangement position is the outlet after the first nip. The web generally loses most of the moisture in the first nip. Accordingly, the space with the steam-saturated effect has a good influence here on the quantity of water being evaporated.

An alternative or additional possibility is to arrange the space after the last nip. In this case, this does not need to be the absolute last nip in the calender. Rather, the space may be arranged after the last of the nips which treats the web equally, that is to say, for example, the last nip in which one side of the web rests on a hard and therefore smooth roll. If the calender is provided with a reversing nip, in order to calender the two sides of the material web approximately equally in each case, then such a box with a steam-saturated space can also be arranged after the last nip which treats the other side of the web with the hard and smooth roll.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. Apparatus for treating a material web, comprising:

at least one nip through which the material web is guided and which is formed between a first revolving heated surface and a second revolving surface;

a box which bounds a space through which the material web is guided is arranged after the nip in the direction of movement of the material web;

a first seal for sealing off the box with respect to the first surface;

a second seal for sealing off the box with respect to the second surface; and a sensor connected to a blowing device, the sensor being configured to detect a relative humidity in the space, the blowing device being configured to convey fresh air into the space to control the relative humidity in the space, wherein the seals are configured to substantially seal at least one of steam, air or any combination thereof, wherein the first surface is heatable to approximately 120° C. and both surfaces in the nip have the same direction of movement as the material web, and the box comprises at least one wall having a heater, and wherein the box is substantially closed in a machine direction except for an inlet opening which is closed by a first wall arranged above the web in the direction of the force of gravity against the first surface and a second wall arranged below the web against the second surface, and an outlet opening through which the material web is guided to the outside, and the box is configured to be substantially closed from ambient atmosphere.

2. Apparatus according to claim 1, wherein the space is bounded on one side by the material web, the box being arranged in contact with the first heated surface.

3. Apparatus according to claim 1, wherein the box has a length in the range from approximately 0.3 to 3 m in the direction of movement of the material web which, while taking account the temperature of the first surface and the speed of the material web, is chosen such that the material web has a temperature of at most 110° C. after passing through the space.

4. Apparatus according to claim 1, wherein at least one wall of the box is heated to at least 100° C.

5. Apparatus according to claim 4, wherein the heated wall is the first wall.

6. Apparatus according to claim 1, wherein the box is at least partly thermally insulated with respect to its surroundings.

7. Apparatus according to claim 1, wherein the blowing device and the sensor are part of a control system which limits the relative humidity in the space to at most 99%.

8. Apparatus according claim 1, wherein said at least one nip comprises a plurality of nips and the space is arranged after a first nip in the direction of movement of the web.

9. Apparatus according to claim 1, wherein said at least one nip comprises a plurality of nips and the space is arranged after a last nip in the direction of movement of the web, which last nip treats the web equally.

10. Apparatus according to claim 1, wherein said at least one nip comprises an extended nip.

11. Apparatus according to claim 1, wherein said at least one nip is formed between a hard roll and a soft roll having a resilient surface.

12. Apparatus according to claim 1, wherein said at least one nip is formed between two hard rolls.

13. Apparatus according to claim 1, wherein said at least one nip has a flat extent and is formed between two circulating belts, said apparatus further comprising pressure shoes for pressing said circulating belts against each other.

14. Apparatus according to claim 1, wherein the first revolving, heated surface comprises a roll and the second revolving surface comprises a cover of a shoe roll.

15. Apparatus according to claim 14, further comprising a support for supporting, in the region of the second seal, the cover of the shoe roll, so that the cover of the shoe roll in the region of the second seal has a defined position in relation to the second seal.

16. Apparatus according to claim 14, wherein the first seal and the second seal bear on one of, the roll or the cover of the shoe roll.

17. Apparatus according to claim 1, wherein the box is sufficiently large to enable the space to extend over an entire width of the web.

18. Apparatus according to claim 17, wherein the box is closed at its sides.

19. Apparatus according to claim 14, wherein the box is heated with the aid of the roll and insulates part of a circumference of the roll with respect to its surroundings.

20. The apparatus of claim 1, wherein the second surface is formed by a circulating cover which is supported by at least one support, the at least one support being positioned under the cover with respect to the second seal in the box and being configured to assist in sealing the box.

21. Apparatus for treating a material web, comprising:

at least one nip through which the material web is guided and which is formed between a roll and a cover of a shoe roll, the roll being heatable to at least 120° C., the roll and the cover of the shoe roll having the same direction of movement as the material web;

a box which bounds a space through which the material web is guided being arranged after the nip in the direction of movement of the material web, at least one wall of the box being heated to at least 100° C., wherein said at least one wall is arranged above the web in a direction of the force of gravity, and wherein the box is at least partly thermally insulated with respect to its surroundings;

a blowing device which conveys fresh air into the space to control a relative humidity in the space;

a sensor connected to the blowing device for determining the relative humidity in the space;

a first seal for sealing off the box with respect to the roll, said first seal bearing on the roll;

a second seal for sealing off the box with respect to the cover of the shoe roll, said second seal bearing on the cover of the shoe roll, wherein the first and second seals are configured to substantially seal at least one of steam, air or any combination thereof, wherein the cover is supported by a support positioned under the cover with respect to the second seal in the box and is configured to assist in sealing the box, wherein the box comprises at least one wall having a heater and the roll comprises heating channels, and wherein the box is substantially closed in a machine direction, except for an inlet opening which is closed by the at least one wall against the roll and a second wall arranged below the web against the cover of the shoe roll, and an outlet opening through which the material web is guided to the outside, and the box is configured to be substantially closed from ambient atmosphere.

* * * * *